US005555564A

United States Patent [19]

Welch

[11] Patent Number: 5,555,564

[45] Date of Patent: Sep. 17, 1996

[54] APPARATUS FOR CLEANING A SHOE SOLE AND METHODS FOR MAKING AND USING SAME

[76] Inventor: Januarius Welch, 11670 Ely, Davisburg, Mich. 48350

[21] Appl. No.: 459,125

[22] Filed: Jun. 2, 1995

[51] Int. Cl.[6] ..... A41B 11/00; A41D 13/00

[52] U.S. Cl. ..... 2/239; 2/22

[58] Field of Search ..... 2/239, 22, 23, 2/241, 242, 227, 61, 16, 24, 62, 231; 36/2 R, 1.5, 72 R, 70 R, 1

[56] References Cited

U.S. PATENT DOCUMENTS

| | | | |
|---|---|---|---|
| 1,225,354 | 5/1917 | Pierce | 2/239 |
| 1,654,452 | 12/1927 | Bradley | 2/227 |
| 2,119,602 | 6/1938 | Roberts et al. | 2/227 |
| 3,995,322 | 12/1976 | Chesebro, Jr. | 2/239 |
| 4,484,360 | 11/1984 | Leighton et al. | 2/61 |
| 4,484,361 | 11/1984 | Leighton et al. | 2/23 |
| 4,669,126 | 6/1987 | Jones | 2/239 |
| 4,675,915 | 6/1987 | Siciliano | 2/181 |
| 4,843,653 | 7/1989 | Coble | 2/170 |
| 5,038,408 | 8/1991 | DeBaene | 2/23 |
| 5,307,522 | 5/1994 | Throneburg et al. | 2/239 |
| 5,421,034 | 6/1995 | Keune | 2/239 |

FOREIGN PATENT DOCUMENTS

| | | |
|---|---|---|
| 142722 | 12/1930 | Switzerland . |
| 508478 | 12/1937 | United Kingdom . |

*Primary Examiner*—Amy B. Vanatta

*Attorney, Agent, or Firm*—Reising, Ethington, Barnard & Perry

[57] ABSTRACT

A shoe sole wiping pad is sewn to the outer surface of an athletic sock's upper tube portion. The wiping pad absorbs and retains moisture and has a moisture-bearing wiping surface that removes dust and debris from the sole of an athletic shoe when the wearer wipes the sole across the pad. A moisture barrier isolates the wiping pad from the upper tube portion of the sock to prevent moisture from soaking into the sock from the wiping pad.

19 Claims, 2 Drawing Sheets

APPARATUS FOR CLEANING A SHOE SOLE AND METHODS FOR MAKING AND USING SAME

TECHNICAL FIELD

This invention relates to garments worn over the foot and lower leg; more particularly, it relates to athletic socks.

BACKGROUND OF THE INVENTION

Athletes who participate in sports played on smooth hard surfaces such as basketball, handball, squash or racquetball courts can improve their traction by periodically cleaning and slightly moistening their shoe soles. Dust and other debris normally accumulate on shoe soles during the course of play and decrease the coefficient of friction between the shoe soles and the court surface. To remove the dust and debris and to slightly moisten their shoe soles, athletes typically wipe their shoes on a damp towel between playing periods. During playing periods, when there is seldom time to exit the court and wipe one's shoes on a damp towel, athletes sometimes clean their shoe soles by spitting into their hands then wiping the soles of their shoes with their saliva-moistened hands.

The prior art discloses socks with structures on which athletes could wipe the soles of their shoes. Such structures are typically foam or fabric pads attached to the upper tube portions of the socks. Although these structures may be capable of absorbing and retaining the moisture needed for cleaning the sole of the shoe, they are adapted to absorb shock or sweat rather than to provide a damp wiping surface for court shoes. In addition, they are not designed to prevent moisture from soaking into the upper tube portion. If court athletes were to moisten these structures to create a shoe-wiping surface, the moisture would soak into their socks causing their socks to become uncomfortably damp. Moreover, moisture introduced into a sock's upper tube portion will inevitably soak into the lower portion of the sock inside the shoe creating a warm, wet, abrasive environment for the wearer's foot. This type of environment can be extremely uncomfortable and can promote foot ailments such as blistering and athlete's foot. Examples of these types of socks are disclosed in U.S. Pat. No. 1,225,354 issued to Pierce on May 8, 1917; U.S. Pat. No. 5,307,522 issued to Throneburg et al. on May 3, 1994; and British Patent Number 508,478 issued to Eyre et al.

The prior art also includes sweat-band-type garments that are worn around a wearer's lower leg or ankle to absorb excess moisture before it can soak into the athlete's sock and create a moist, warm environment inside the athlete's shoe. For example, U.S. Pat. No. 4,675,915, issued to Siciliano on Jun. 30, 1987, includes a moisture-absorbing pad in the form of a moisture-absorbent outer sleeve and a moisture barrier in the form of a non-moisture-absorbent inner sleeve. The inner sleeve and outer sleeve are worn directly against the skin on the lower leg or ankle. The inner sleeve does not isolate the outer sleeve from the wearer's leg. Instead, the outer sleeve extends upward beyond the upper edge of the inner sleeve so that it may contact the wearer's skin and intercept and absorb sweat as it moves downward along the wearer's leg. The Siciliano patent also discloses the inner and outer sleeves in integral combination with a fabric sock but does not show the inner sleeve layered between the outer sleeve and the upper tube portion of the sock.

SUMMARY OF THE INVENTION

The present invention provides a garment with a sole-wiping pad that overcomes the shortcomings of current structures that athletes use to clean and slightly moisten the soles of their shoes. The present invention also provides a method for using the garment that overcomes the drawbacks of current methods that athletes use to clean their shoe soles. The invention also provides a method for manufacturing the garment. To make the garment a manufacturer attaches the sole-wiping pad to the upper tube portion of a sock. To clean his or her shoe soles, an athlete dons the garment on his or her lower leg, applies moisture to the sole-wiping pad then wipes the sole of his opposite shoe across the dampened pad. The garment includes a moisture barrier to prevent moisture from soaking into the athlete's socks from the damp wiping surface.

BRIEF DESCRIPTION OF THE DRAWINGS

To better understand and appreciate this invention's advantages, refer to the following detailed description in connection with the accompanying drawings.

DETAILED DESCRIPTION OF THE PREFERRED EMBODIMENT

Figure 2:
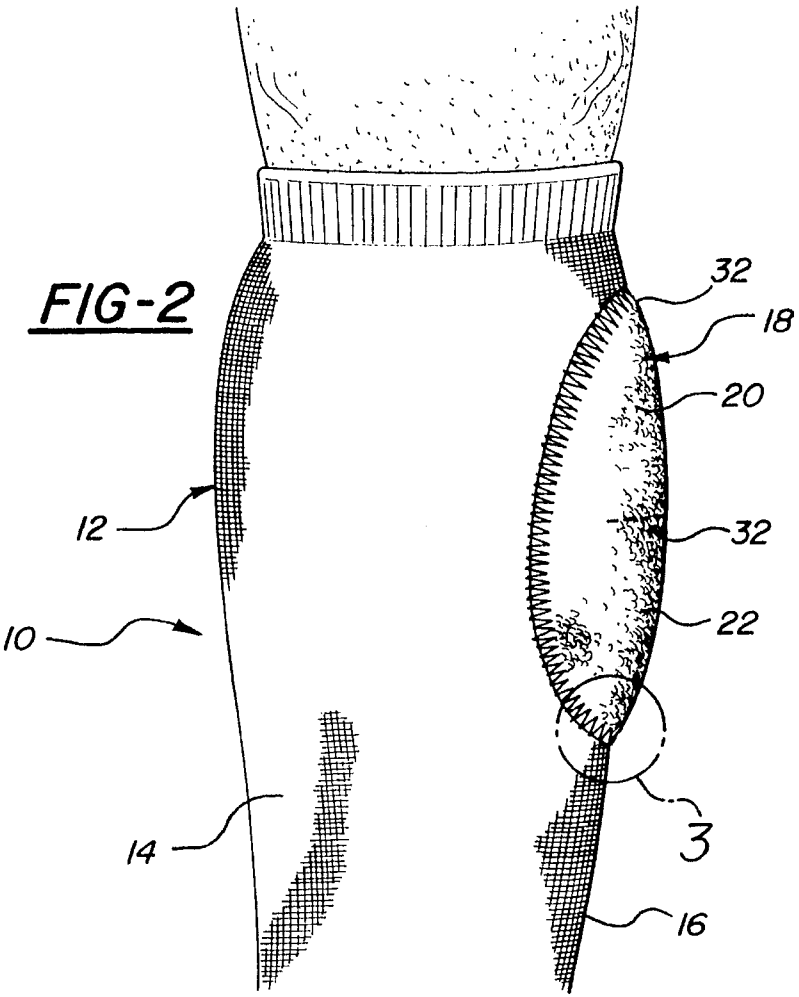
FIG. 2 is an enlarged front view of the invention shown in FIG. 1.

A garment of the type worn over the lower leg and foot is generally shown at 10 in FIGS. 1–4. The garment 10 includes a sock 12 with an upper tube portion 14 having an outer surface 16. A wiping pad, generally indicated at 18 in FIGS. 1–4, is disposed adjacent the outer surface 16 of the upper tube portion 14. The wiping pad 18 includes a moisture-retaining portion, best shown at 20 in FIG. 3, and a moisture-bearing wiping surface 22 for slightly moistening and wiping dust and debris from the sole of an athletic shoe 24 to improve traction. Stitches 32, 34 connect the wiping pad 18 to the upper tube portion 14. A moisture barrier 28 is disposed between the outer surface 16 and the wiping pad 18 to prevent moisture from moving into the upper tube portion 14 from the wiping pad 18.

The upper tube portion 14 of the garment 10 is a seamless, elastic fabric tube that stretches to conform to the shape of the wearer's ankle and calf. The upper tube portion 14 extends from the ankle region, over the calf to just below the knee. The wiping pad 18 and the moisture barrier 28 are attached to the inner calf area of the upper tube portion 14.

Figure 1:
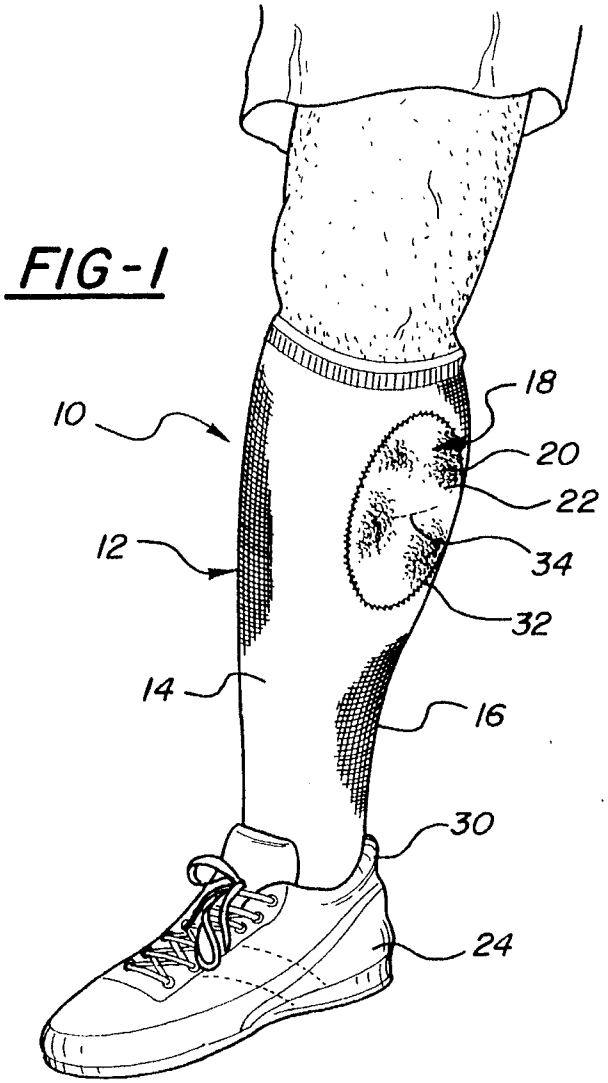
FIG. 1 is a perspective view of a sport sock having a wiping pad according to the invention.
Figure 4:
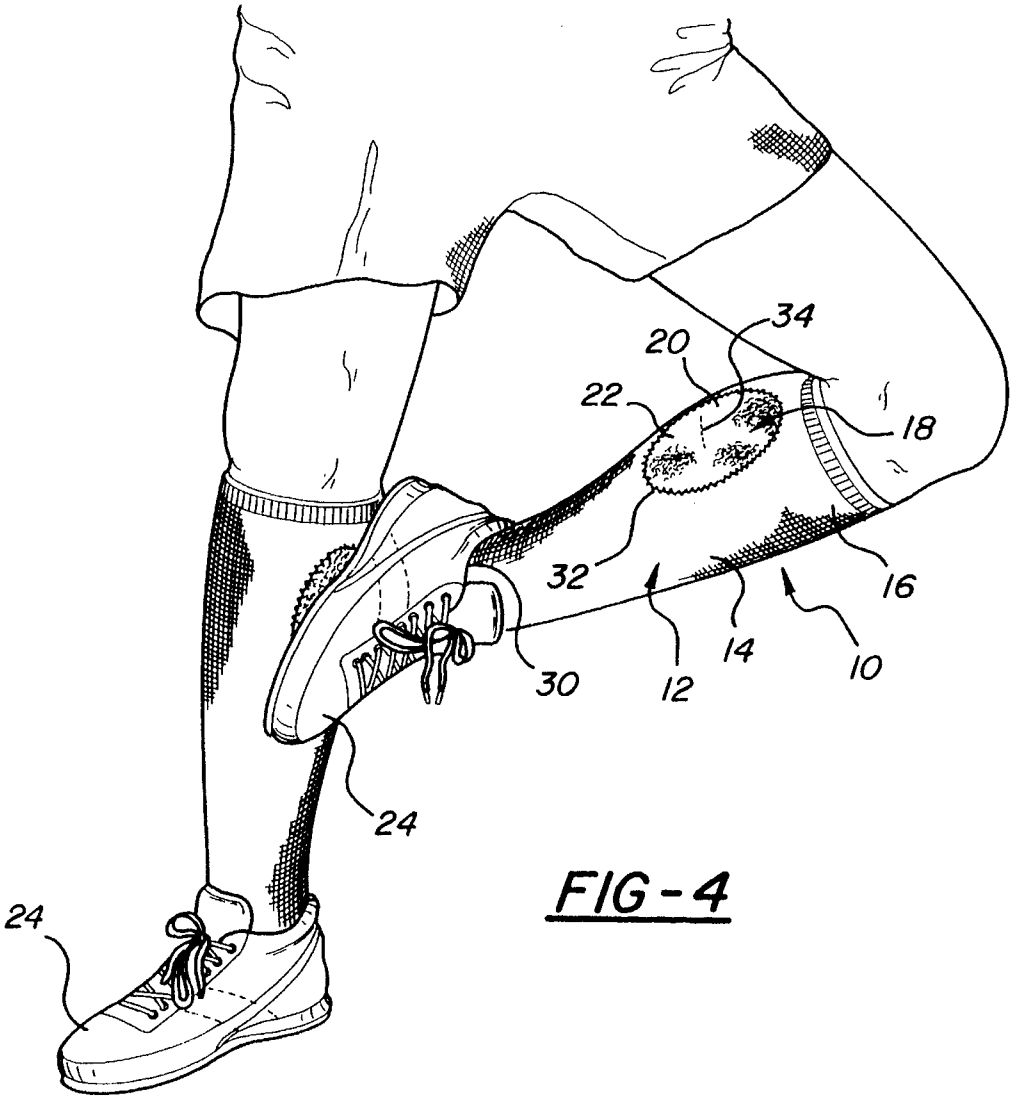
FIG. 4 is a perspective view of an athlete using the invention to clean one of his shoe soles.

The garment 10 includes a lower tube portion, shown at 30 in FIGS. 1 and 4, integrally woven with the upper tube portion 14 to form sock 12 as a single unitary garment. The lower tube portion 30 is an elastic fabric tube that stretches to conform to the shape of the wearer's foot. The lower tube portion 30 extends from the wearer's ankle region downward over the heel and forward to cover the toes. The lower tube portion 30 is sewn or woven together at the toe forming a closed end of the sock 12.

Figure 3:
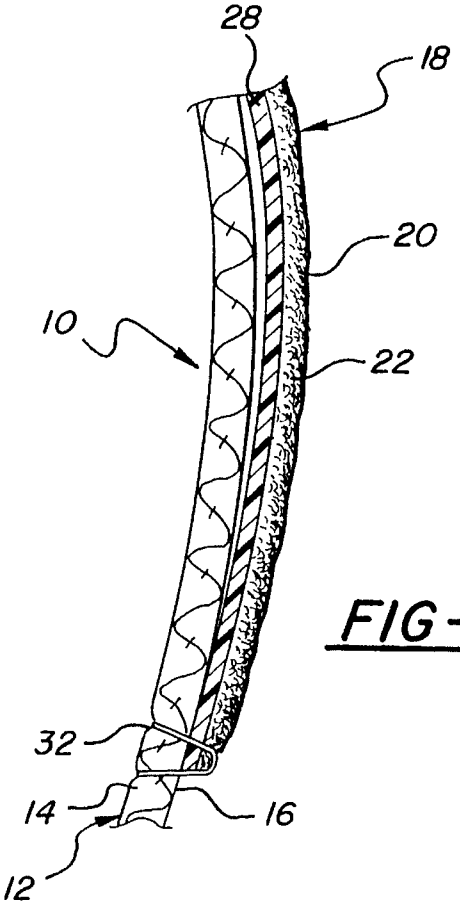
FIG. 3 is a further-enlarged partial cross-sectional front view of the region of the invention enclosed in circle 3 in FIG. 2.

As shown in FIG. 3, the moisture barrier 28 prevents the wiping pad 18 from contacting the upper tube portion 14. The moisture barrier 28 is a moisture-proof layer that completely separates the wiping pad 18 from the outer surface 16 of the upper tube portion 14.

The wiping pad 18 is a circular-cut fabric patch, approximately five to six inches in diameter, and is attached to the sock 12 adjacent the outer surface 16 of the upper tube portion 14. The wiping surface 22 is disposed on the moisture-retaining portion 20. The wiping pad 18 is bonded to the moisture barrier 28. The bonding process makes one surface of the wiping pad 18 moisture-proof.

As shown in FIG. 3, the moisture-retaining portion 20 of the wiping pad 18 comprises a mat of interwoven nylon fibers capable of absorbing moisture and retaining it for an extended period of time. Fabric that comprises a moisture barrier 28 bonded to a mat of interwoven nylon fibers is available from Princess Fabrics of New York, N.Y. under the trade name DRY MAX™. Princess Fabrics calls the process of bonding a moisture-proof backing to fabric "plastifying".

As is best shown in FIGS. 2 and 3, a border stitch 32 attaches the plastified fabric patch 18, 28 to the upper tube portion 14 of the sock 12. The border stitch 32 is a strand of thread sewn through the patch 18, 28 and the upper tube portion 14. The border stitch 32 is a type of stitch known as a "serge" stitch—a flexible zig-zag stitch that is able to stretch with the upper tube portion 14 fabric.

Prior to stitching, the upper tube portion 14 is stretched open using a 7 to 8 inch quilting hoop. A 7 to 8 inch quilting hoop approximates the amount of stretch that the calf of an average-sized adult male would impart to the upper tube portion 14 fabric. The size of quilting hoop would be correspondingly smaller for smaller men's, women's and children's sock sizes. By pre-stretching the upper tube portion 14 fabric before sewing the patch 18, 28 in place, the manufacturer can ensure that attachment of the patch 18, 28 will not alter the fit of the sock 12. If a non-elastic patch 18, 28 were sewn in place without first stretching the upper tube portion 14 of the sock 12, the patch 18, 28 would restrict a section of the upper tube portion 14 and prevent it from properly stretching to conform to the wearer's calf.

A middle stitch 34 is sewn across the middle portion of the patch 18, 28. The middle stitch 34 includes a strand of thread that is sewn through the patch 18, 28 and the upper tube portion 14 binding them together. The middle stitch 34 prevents the patch 18, 28 from falling off the upper tube portion 14 should the border stitch 32 fail. The middle stitch 34 is a straight stitch, i.e., a simple, non-flexible in-and-out stitch.

To use this invention to clean the sole of an athletic shoe 24, the moisture-retaining wiping pad 18 is first attached to the upper tube portion 14 of a sock 12. The wearer then dons the sock 12 over one foot and lower leg. The wearer then dons an athletic shoe 24 on the opposite foot. Moisture is then applied to the wiping pad 18. The wearer then wipes the sole of the athletic shoe 24 across the wiping pad 18 to remove dirt and debris and to improve traction between the sole of the shoe 24 and hard playing surfaces. To remove residual moisture from the sole of the athletic shoe 24 after cleaning, the wearer may then wipe the sole across a dry portion of the sock 12.

In alternative embodiments, the upper tube portion 14 may extend to a lesser height, and need not be integrally woven with the lower tube portion 30. Rather than being woven to a lower tube portion, the upper tube portion 14 may connect instead to a stirrup portion that loops under the foot. The upper tube portion 14 may also be a simple tube of fabric with no foot portion or stirrup. This "simple tube" embodiment could either be pulled over a pair of athletic socks or worn around the calf, in direct contact with the skin, above a low-rise "footie" that extends only to the ankle.

As an alternative to sewing a plasticized fabric patch 18, 28 to the upper tube portion 14, the wiping pad 18 and moisture barrier 28 may also be removably attached to the upper tube portion 14 by separable fastening means such as hook & pile-type fastening surfaces available under the trade name VELCRO®. In alternative embodiments using VELCRO® or other removable attachment means, the wearer may attach the wiping pad 18 and barrier 28 after donning the sock 12.

Other embodiments may also include a dry pad sewn to the upper tube portion 14 for wiping excess moisture from the sole of an athletic shoe 24 that has been wiped across a damp wiping pad 18.

The wiping pad 18 may be cut from materials other than DRYMAX™ such as terry cloth. A "plastified" terry cloth material is available from Princess Fabrics under the trade name TERRY WITH A TWIST™.

The wiping pad 18 or plasticized fabric patch 18, 28 may, of course, be cut in shapes other than circular, e.g., oval, rectangular, square, diamond or triangular. The wiping pad or plasticized fabric patch 18, 28 may also be band-shaped to extend completely around the circumference of the wearer's leg. The inner calf area is the preferred location, however, because it is the easiest location for the wearer to reach with the sole of his or her opposite shoe.

The moisture barrier 28 need not be a plasticized surface pre-bonded to the wiping pad 18. It may alternatively be a separate sheet of moisture-proof material sandwiched between the wiping pad 18 and the upper portion of the sock 12. The barrier may be held in place by any one of a number of suitable attachment means to include sewing, gluing or removably attaching with separatable fastening means such as VELCRO® hook and pile-type fasteners.

This invention allows an athlete to quickly clean and dry the soles of his or her shoes 24 thereby improving traction on hard playing surfaces. The invention provides a shoe cleaning method so quick and effective that an athlete may clean and dry his or her shoes without having to either interrupt play, wait for a "time-out", or wait for a break between playing periods.

This description illustrates the invention using descriptive rather than limiting words. Obviously, there are many ways one might modify this invention in light of the above teachings. Within the scope of the claims one may practice the invention other than as the description indicates.

I claim:

1. A garment of the type worn surrounding the lower portion of one leg, said garment comprising:

an upper tube portion having the shape of a single tube and extending from a lower ankle region to and truncating at an upper band to allow said ankle region to encircle the leg at a point below the calf and adjacent the ankle of a human leg while said upper band encircles the leg at a point below the crotch and adjacent the knee;

a wiping pad supported adjacent an outer surface of said upper tube portion to absorb and retain moisture, said wiping pad including a wiping surface to wipe dust and debris from the sole of an athletic shoe to improve traction;

a moisture barrier supported between said wiping pad and said upper tube portion and shaped to prevent any portion of said wiping pad from contacting or transferring moisture to the leg or said upper tube portion.

2. A garment as defined in claim 1 wherein said moisture barrier comprises a moisture-proof layer sandwiched between said outer surface and said wiping pad.

3. A garment as defined in claim 2 wherein said moisture-proof layer is made of an elastomeric polymeric material.

4. A garment as defined in claim 2 wherein said wiping pad comprises a patch of moisture-retaining material.

5. A garment of the type worn over the foot and lower leg, said garment comprising:

an upper tube portion having an outer surface and an inner calf area;

a wiping pad supported adjacent said outer surface to absorb and retain moisture, said wiping pad including a wiping surface to wipe dust and debris from the sole of an athletic shoe to improve traction, said wiping pad comprising a patch of moisture-retaining material;

a moisture barrier supported between said wiping pad and said upper tube portion and adapted to prevent any portion of said wiping pad from contacting or transferring moisture to the lower leg or said upper tube portion, said moisture barrier comprising a moisture-proof layer sandwiched between said outer surface and said wiping pad; said patch and said moisture barrier being attached to said inner calf area.

6. A garment as defined in claim 4 wherein said patch is bonded to said moisture-proof layer.

7. A garment as defined in claim 6 wherein said patch comprises a mat of interwoven nylon fibers.

8. A garment as defined in claim 6 wherein said patch comprises terry cloth.

9. A garment as defined in claim 2 wherein said garment includes a lower tube portion integrally formed with said upper tube portion as a single unitary sock.

10. A garment as defined in claim 2 wherein said wiping pad includes a border and wherein said garment includes a border stitch disposed along said border, said border stitch comprising a strand of thread sewn through said moisture barrier and said wiping pad and said upper tube portion.

11. A garment as defined in claim 2 wherein said pad includes a middle portion and wherein said garment includes a middle stitch sewn across said middle portion, said middle stitch comprising a strand of thread sewn through said moisture barrier and said wiping pad and said upper tube portion.

12. A garment as defined in claim 1 further comprising a second wiping pad for removing excess moisture from the sole of an athletic shoe.

13. A garment of the type worn over the foot and lower leg, said garment comprising:

an upper tube portion having an inner calf area with an outer surface;

a patch attached to said inner calf area adjacent said outer surface to absorb and retain moisture, said patch including a wiping surface to wipe dust and debris from the sole of an athletic shoe to improve traction;

a moisture proof layer sandwiched between said outer surface and said wiping surface to prevent said wiping surface from contacting or transferring moisture to the lower leg or said upper tube portion.

14. A method for cleaning the sole of an athletic shoe using a garment of the type worn over the foot and lower leg and comprising an upper tube portion having an outer surface and a wiping pad supported adjacent said outer surface; said method comprising the steps of:

donning the garment over one foot and lower leg;

donning an athletic shoe having a sole on the opposite foot;

applying moisture to the wiping pad;

wiping the sole of the athletic shoe across the wiping pad to remove dirt and debris.

15. A method for making a garment of the type worn surrounding the lower portion of one leg and including an upper tube portion having the shape of a single tube and extending from a lower ankle region to and truncating at an upper band and a wiping pad having a wiping surface disposed adjacent the upper tube portion, said method comprising the steps of:

positioning a moisture barrier between the outer surface of the upper tube portion of the garment and the wiping pad; and attaching the wiping pad and moisture barrier to the outer surface of an inner calf area the upper tube portion after said step of positioning the moisture barrier between the outer surface of the upper tube portion and the wiping pad.

16. A method as set forth in claim 15 further including the step of attaching the moisture barrier to the wiping pad prior to the step of attaching wiping pad and moisture barrier to the outer surface of the upper tube portion.

17. A method as set forth in claim 15 wherein the step of attaching the wiping pad and moisture barrier to the outer surface of the upper tube portion includes the step of sewing the wiping pad to the upper tube portion.

18. A method as set forth in claim 17 including the step of circumferentially stretching the upper tube portion prior to said step of sewing the wiping pad to the upper tube portion.

19. A method as set forth in claim 17 including the step of inserting a quilting hoop into the upper tube portion prior to said step of sewing the wiping pad to the upper tube portion.

* * * * *